US009180989B2

(12) United States Patent
Kim et al.

(10) Patent No.: US 9,180,989 B2
(45) Date of Patent: Nov. 10, 2015

(54) FOOD ISOLATOR WITH QUICK-RELEASE PERFORATION

(71) Applicants: Chun Pil Kim, Edgewater, NJ (US); Matthew Park, Edgewater, NJ (US)

(72) Inventors: Chun Pil Kim, Edgewater, NJ (US); Matthew Park, Edgewater, NJ (US)

( * ) Notice: Subject to any disclaimer, the term of this patent is extended or adjusted under 35 U.S.C. 154(b) by 0 days.

(21) Appl. No.: 14/287,695

(22) Filed: May 27, 2014

(65) Prior Publication Data

US 2014/0312104 A1 Oct. 23, 2014

(51) Int. Cl.

| | |
|---|---|
| ***B65B 11/00*** | (2006.01) |
| ***B65B 61/02*** | (2006.01) |
| ***B65B 67/08*** | (2006.01) |
| ***B65D 75/14*** | (2006.01) |
| ***A47G 21/00*** | (2006.01) |
| ***B65D 75/58*** | (2006.01) |
| ***B65D 65/22*** | (2006.01) |
| ***B65B 25/08*** | (2006.01) |
| ***B65D 65/04*** | (2006.01) |
| ***B65D 65/12*** | (2006.01) |

(Continued)

(52) U.S. Cl.

CPC ..... *B65B 11/004* (2013.01); *A47G 21/001* (2013.01); *B65B 25/08* (2013.01); *B65B 61/02* (2013.01); *B65B 67/08* (2013.01); *B65D 57/00* (2013.01); *B65D 65/04* (2013.01); *B65D 65/12* (2013.01); *B65D 65/22* (2013.01); *B65D 75/04* (2013.01); *B65D 75/14* (2013.01); *B65D 75/585* (2013.01); *B65D 75/5827* (2013.01); *B65D 2571/00561* (2013.01)

(58) Field of Classification Search

CPC ..... B65B 11/48; B65B 67/08; B65B 61/02; B65B 11/02; B65B 11/004; B65B 25/08; B65D 2571/00561; B65D 75/585; B65D 75/5827; B65D 75/14; B65D 65/22; B65D 65/04; B65D 65/12; B65D 65/10; B65D 57/00; A47G 21/001

USPC ..... 53/412, 445, 447, 461, 462, 474, 475, 53/157; 229/87.05, 87.08, 87.11, 938; 426/119, 122, 124, 410

See application file for complete search history.

(56) References Cited

U.S. PATENT DOCUMENTS 2,451,318 A * 10/1948 Burstiner ..... 426/119
2,555,033 A * 5/1951 Harris ..... 426/119

(Continued)

FOREIGN PATENT DOCUMENTS

DE 102006041339 A1 * 3/2008 ..... B65D 75/5827
EP 1291294 A1 * 3/2003 ..... B65D 75/5827

(Continued)

*Primary Examiner* — Stephen F Gerrity
(74) *Attorney, Agent, or Firm* — Eaton & Van Winkle, LLP; Robert D. Katz, Esq.

(57) ABSTRACT

Disclosed herein is a food isolator packaging material. The food isolator packaging includes a first section and a second section, the first section including a plurality of deposit areas each having a perforation. A first food layer is deposited on a first deposit area of the plurality of deposit areas and a second food layer is deposited on a second deposit area of the plurality of deposit areas. The food isolator packaging is folded such that the second section covers the first food layer in the first deposit area and the second food layer in the second deposit area. The food isolator packaging is folded along an axis situated between the first deposit area and the second deposit area such that a perforation of the first deposit area and a perforation of the second deposit area are in alignment.

8 Claims, 17 Drawing Sheets

(51) Int. Cl.
*B65D 75/04* (2006.01)
*B65D 57/00* (2006.01)

(56) References Cited

U.S. PATENT DOCUMENTS 2,673,807 A * 3/1954 Berg ..... 426/124
3,095,088 A * 6/1963 Blaikie et al. ..... 206/440
3,145,112 A * 8/1964 Boegershausen ..... 426/129
3,181,695 A * 5/1965 Taterka et al. ..... 229/87.16
3,187,987 A * 6/1965 Langdon ..... 229/87.16
3,369,657 A * 2/1968 Quade et al. ..... 229/87.16
3,409,121 A * 11/1968 Taterka ..... 229/87.16
4,520,035 A * 5/1985 Lamonica ..... 426/124
4,756,939 A * 7/1988 Goodwin ..... 426/124
4,777,054 A * 10/1988 Greenhouse ..... 229/87.05
5,768,857 A * 6/1998 Ward et al. ..... 53/447
7,240,797 B1 * 7/2007 Grossman ..... 426/119
7,726,486 B2 * 6/2010 Jones ..... 229/87.05
8,551,545 B2 * 10/2013 Feldmeier et al. ..... 426/119
2007/0080197 A1 * 4/2007 Bailey et al. ..... 229/87.05
2007/0237862 A1 * 10/2007 Pinkston ..... 426/106
2013/0189393 A1 * 7/2013 Traldi ..... 426/5
2014/0251864 A1 * 9/2014 Voeller ..... 229/87.08

FOREIGN PATENT DOCUMENTS

JP 4264123 B1 * 5/2009 ..... B65B 11/48
WO WO 2008055654 A1 * 5/2008 ..... A47G 21/001

* cited by examiner

FOOD ISOLATOR WITH QUICK-RELEASE PERFORATION

TECHNICAL FIELD

The present invention relates in general to food packaging, and, more particularly, to a food packaging assembly configured to separate distinct layers of food and facilitate quick-release removal of the food packaging assembly.

BACKGROUND

Food packaging materials are essential to the assembly, production, transportation and delivery of food products from manufacturers and retailers to consumers. The design of food packaging materials must balance the needs of food manufacturers, retailers and consumers. As such, food packaging materials must be inexpensive to minimize overhead costs to manufacturers, retailers and consumers. Simultaneously, these materials must also be effective at protecting the quality and freshness of the contained food products. They must also be configured to enable rapid preparation and assembly of the food product, and be easy to incorporate into both manual and automated food production lines. The food packaging materials must be consistently easy to remove to minimize inconvenience to the consumer. The food packaging materials must also protect the integrity of the food product during removal, ensuring maximum consumer satisfaction of the product, and protecting the interests of the manufacturers and retailers.

BRIEF SUMMARY OF THE INVENTION

Other exemplary aspects, advantages, and salient features of the invention will become apparent to those skilled in the art from the following detailed description, which, taken in conjunction with the annexed drawings, discloses exemplary embodiments of the invention.

In one aspect of the invention, a method of assembling a food product utilizing a food isolator packaging is disclosed. The method includes: providing a food isolator packaging including a first section and a second section, the first section including a plurality of deposit areas each having a perforation, depositing a first food layer on a first deposit area of the plurality of deposit areas and a second food layer on a second deposit area of the plurality of deposit areas, folding the food isolator packaging such that the second section covers the first food layer in the first deposit area and the second food layer in the second deposit area, and folding the food isolator packaging along an axis situated between the first deposit area and the second deposit area such that a perforation of the first deposit area and a perforation of the second deposit area are in alignment.

In another aspect of this disclosure, a food isolator packaging is disclosed, including a first section divided into a plurality of deposit areas, each deposit area configured to receive a separate food layer and having a perforation, and a second section disposed adjacent to the first section, configured to fold and cover food layers deposited on the plurality of deposit areas, wherein the first section and second section are folded along at least one axis situated between two of the plurality of deposit areas such that perforations of the first section and the second section are in alignment.

In another aspect of this disclosure, a food isolator packaging is disclosed, comprising a first section configured to receive a single food layer and having a perforation, and a second section disposed adjacent to the first section, configured to fold and cover the single food layer deposited on the plurality of deposit areas, the perforation extending into the second section.

The invention will become apparent to those skilled in the art from the following detailed description, which, taken in conjunction with the accompanying drawings, discloses example embodiments of the invention.

DETAILED DESCRIPTION

Exemplary, non-limiting embodiments of the present invention will now be described more fully with reference to the accompanying drawings. The claimed invention may, however, be embodied in many different forms and should not be construed as limited to the exemplary embodiments set forth herein. The principles and features of the claimed invention may be employed in varied and numerous embodiments without departing from the scope of the invention.

Furthermore, well-known or widely used techniques, elements, structures, and processes may not be described or illustrated in detail to avoid obscuring appreciation of the present invention by a person of ordinary skill in the art. Although the drawings represent exemplary embodiments of the invention, the drawings are not necessarily to scale and certain features may be exaggerated or omitted in order to better illustrate and explain the present invention.

The present invention relates to a food isolator packaging material and method of use. The food isolator packaging isolates layers of food from one another, preserving freshness of the product until it is ready to eat. Additionally, the food isolator packaging is itself very simple to manufacturer, being little more than a particular arrangement of, for example, creases, folds and perforations on a sheet of material suitable for packaging food. Finally, the arrangement of the creases, folds and perforations facilitates very easy and quick removal of the food isolator packaging by the consumer at the point of consumption.

The food isolator packaging may be formed of any suitable material, including but not limited to, aluminum foil, parchment paper, styrofoam, flexible plastic or a combination of any of the aforesaid materials suitable for food packaging.

Figure 1:
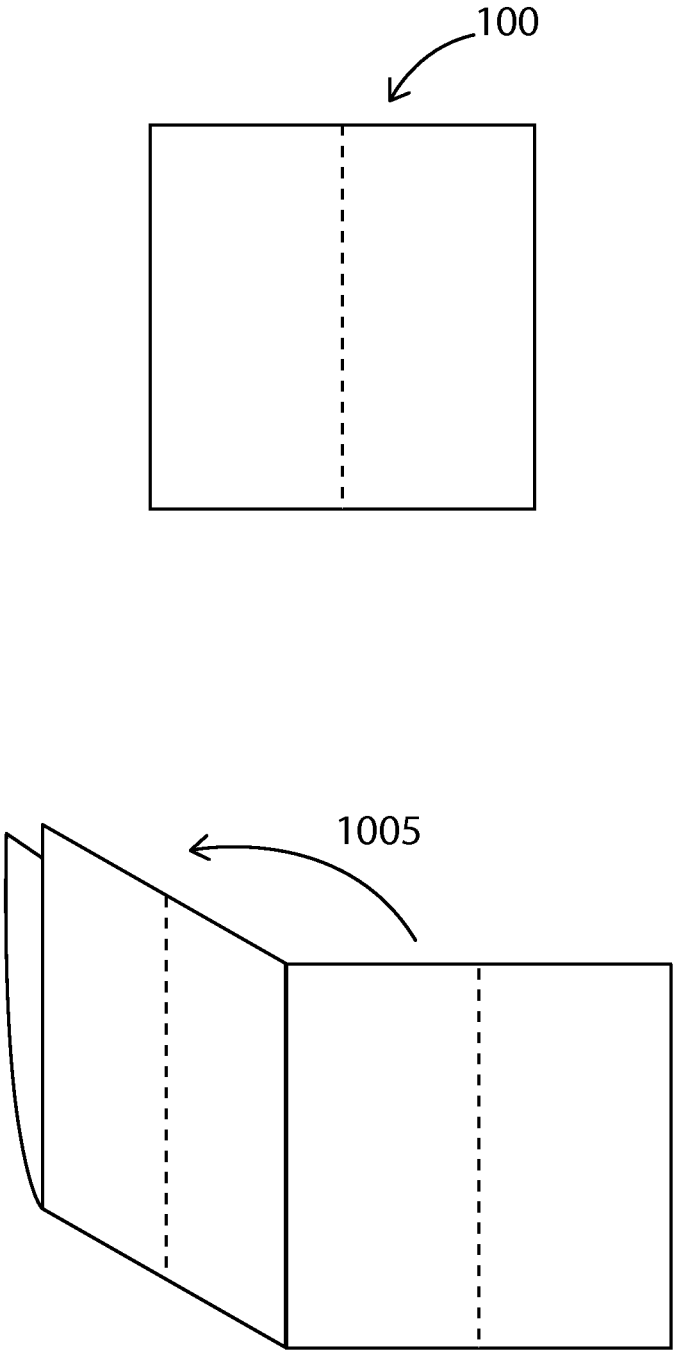
FIG. 1 illustrates one example embodiment of a food isolator packaging material in a pre-folded state.

FIG. 1 illustrates one example embodiment of a food isolator packaging 100 in a pre-folded state. The food isolator packaging 100 may be pre-folded by a manufacturer and unfolded during the assembly of a food product. According, the food isolator packaging may be unfolded in a first direction 1005.

Figure 2:
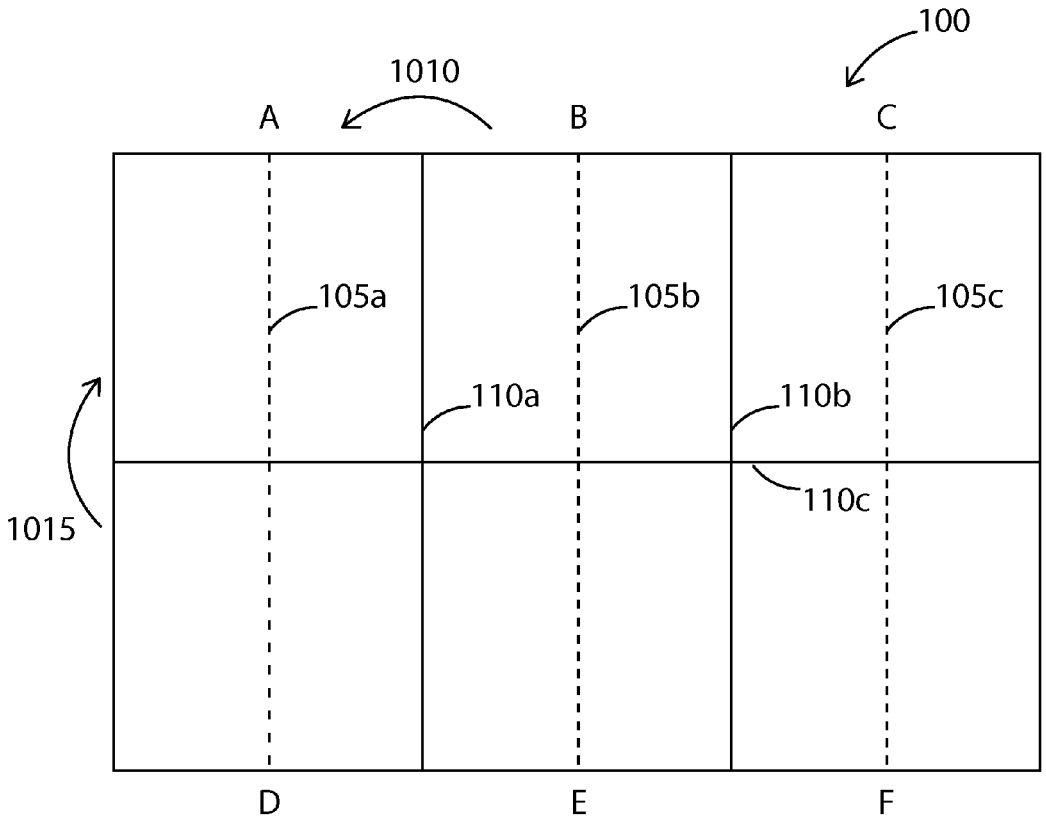
FIG. 2 illustrates one example embodiment of a food isolator packaging material in an un-folded state.

Referring now to FIG. 2, after subsequent unfolding operations 1010 and 1015, the food isolator packaging 100 may reach the state depicted herein. Accordingly, the food isolator packaging 100 may define a number of discrete areas A, B, C, D, E, F, as separated by the latitudinal creases 110*a* and 110*b*, and the longitudinal crease 110*c*. It is understood that the food isolator packaging 100 depicted herein is for example purposes only, and the food isolator packaging material may include more or less discrete sections according to a desired configuration or requirement according to user preference, food product requirements, manufacturer requirements, etc.

The food isolator packaging 100 may be defined as having a first section including discrete areas A, B and C and a second section including discrete areas D, E and F.

Additionally, a number or perforations 105*a*, 105*b* and 105*c* are provided. Although the perforations 105*a*, 105*b* and 105*c* are depicted herein as extending through a central axis of each discrete area set A & D, B & E and C & F herein, it is understood other configurations are contemplated, as will be described further below. Additionally, although the perforations 105*a*, 105*b* and 105*c* are depicted as extending from a first edge of the food isolator packaging 100 to a terminal edge of the food isolator packaging 100, any other configuration is possible. For example, the perforations 105*a*, 105*b* and 105*c* may extend from an interior point of the food isolator packaging 100, or terminate at an interior point of the food isolator packaging 100.

Figure 3:
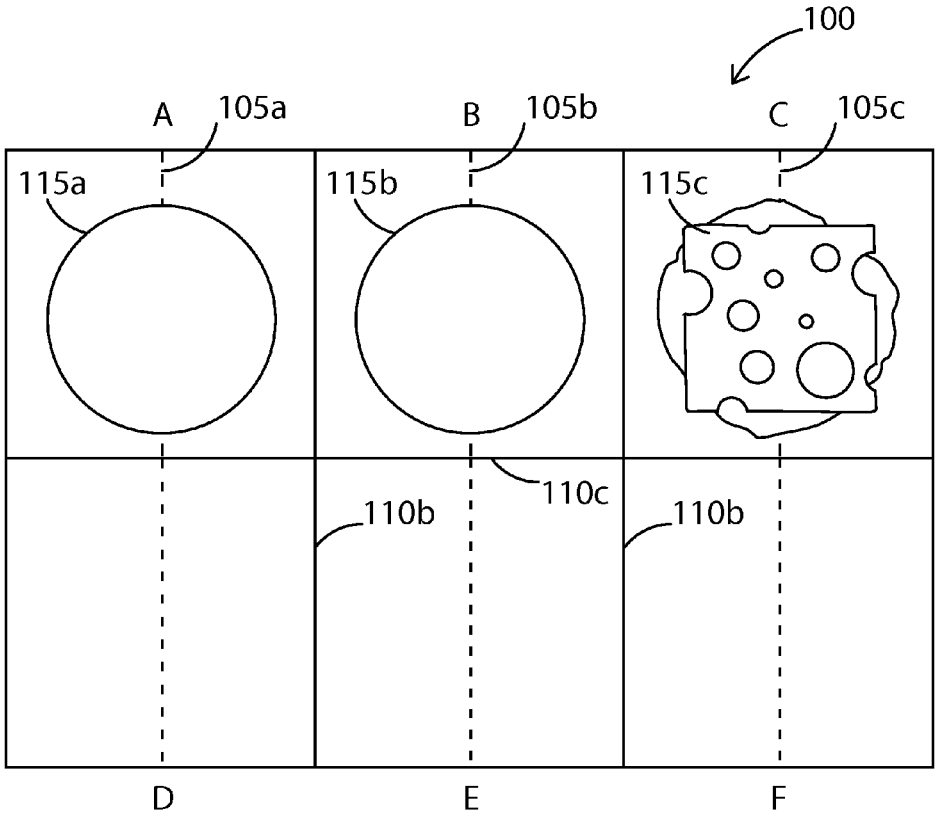
FIG. 3 illustrates one example embodiment of assembly of a food product utilizing an example food isolator packaging material.

FIG. 3 illustrates one example embodiment of assembly of a food product utilizing an example food isolator packaging material. Food products may be placed on the discrete areas A, B and C, corresponding to the first section of the food isolator packaging 100. For example, if a sandwich food product is to be assembled using the food isolator packaging 100, then bread layers 115*a* and 115*b* may be placed as shown, and a meat and cheese layer 115*c* may be placed as shown. Thus, when the food isolator packaging 100 is assembled, the interposition of layers of the food isolator packaging 100 between bread layers 115*a* and 115*b* and the meat and cheese layer 115*c* will prevent moisture or oil from the meat and cheese layer 115*c* from contaminating the bread layers 115*a* and 115*b*, facilitating an increased level of freshness in the assembled sandwich at the point of consumption.

Figure 4:
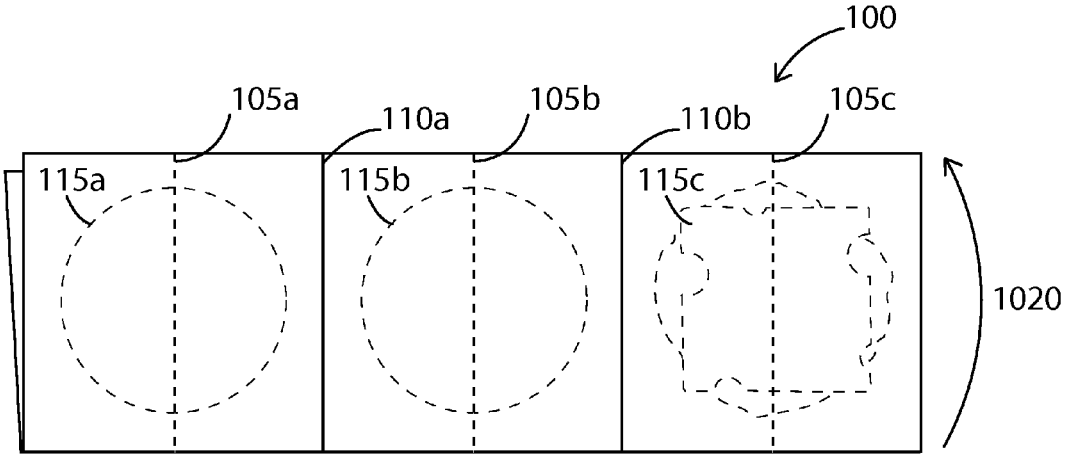
FIG. 4 illustrates one example embodiment of assembly of a food product utilizing an example food isolator packaging material.
Figure 4:
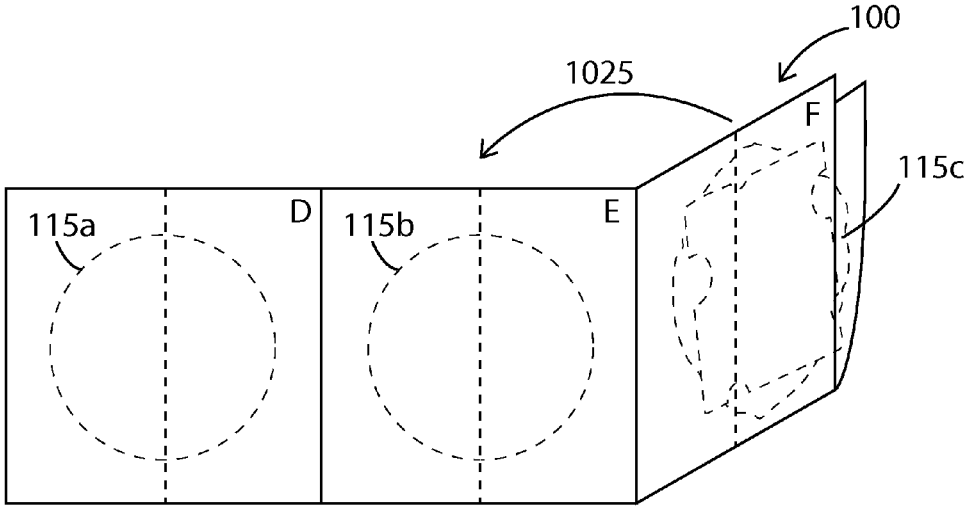

Referring now to FIG. 4, once the layers of the food product have been placed on the respective discrete areas A, B and C, the food isolator packaging 100 may be folded according to operation 1020 along the longitudinal crease 110*c* such that the second section (corresponding to the discrete areas D, E and F) cover the bread layers 115*a* and 115*b* and the meat and cheese layer 115*c*. Subsequently, the meat and cheese layer 115*c* may be prepared for disposition between the bread layers 115*a* and 115*b*. Accordingly, the portion of the food isolator packaging 100 corresponding to discrete areas E and F may be folded along the crease 110*b* via operation 1025.

It is noted here that the placement of the respective food layers in the respective discrete areas A, B and C may influence the order of folding of the food isolator packaging 100 so that the desired arrangement of food layers is achieved in the final product. Similarly, the folding order of the food isolator packaging 100 may also be altered to achieve the desired arrangement of food layers in the final product.

Figure 5:
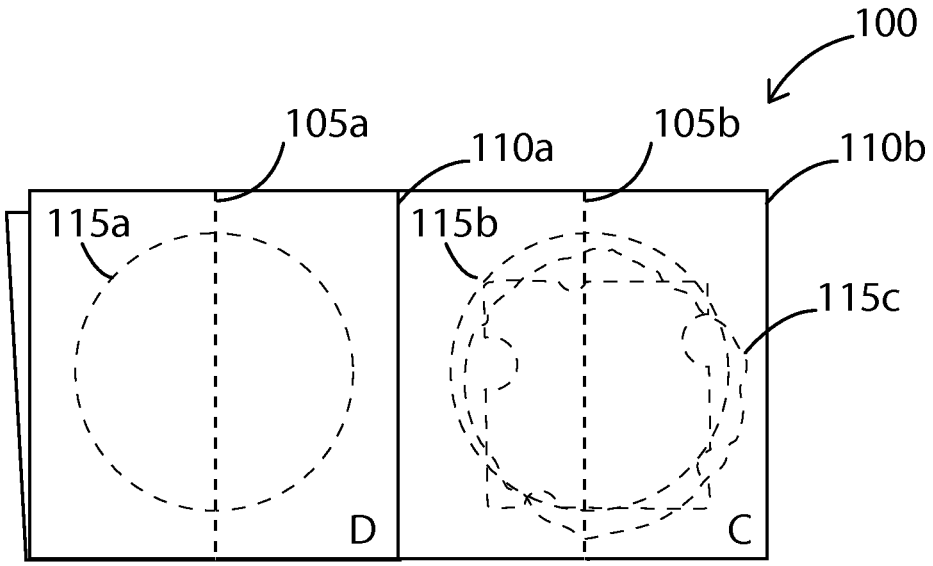
FIG. 5 illustrates one example embodiment of assembly of a food product utilizing an example food isolator packaging material.
Figure 5:
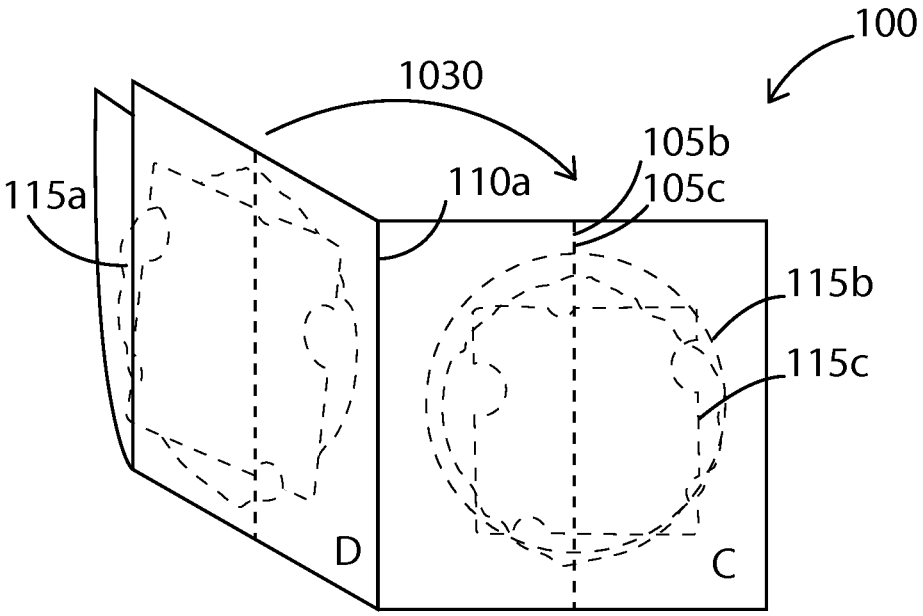

After the completion of operation 1025, the arrangement shown in FIG. 5 is achieved. The meat and cheese layer 115*c* is thus disposed over the bread layer 115*b*, but separated by the discrete areas E and F (not shown), and the perforations 105*b* and 105*c* are aligned. Subsequently, the food isolator packaging 100 may again be folded along the crease line 110*a* via operation 1030.

Figure 6:
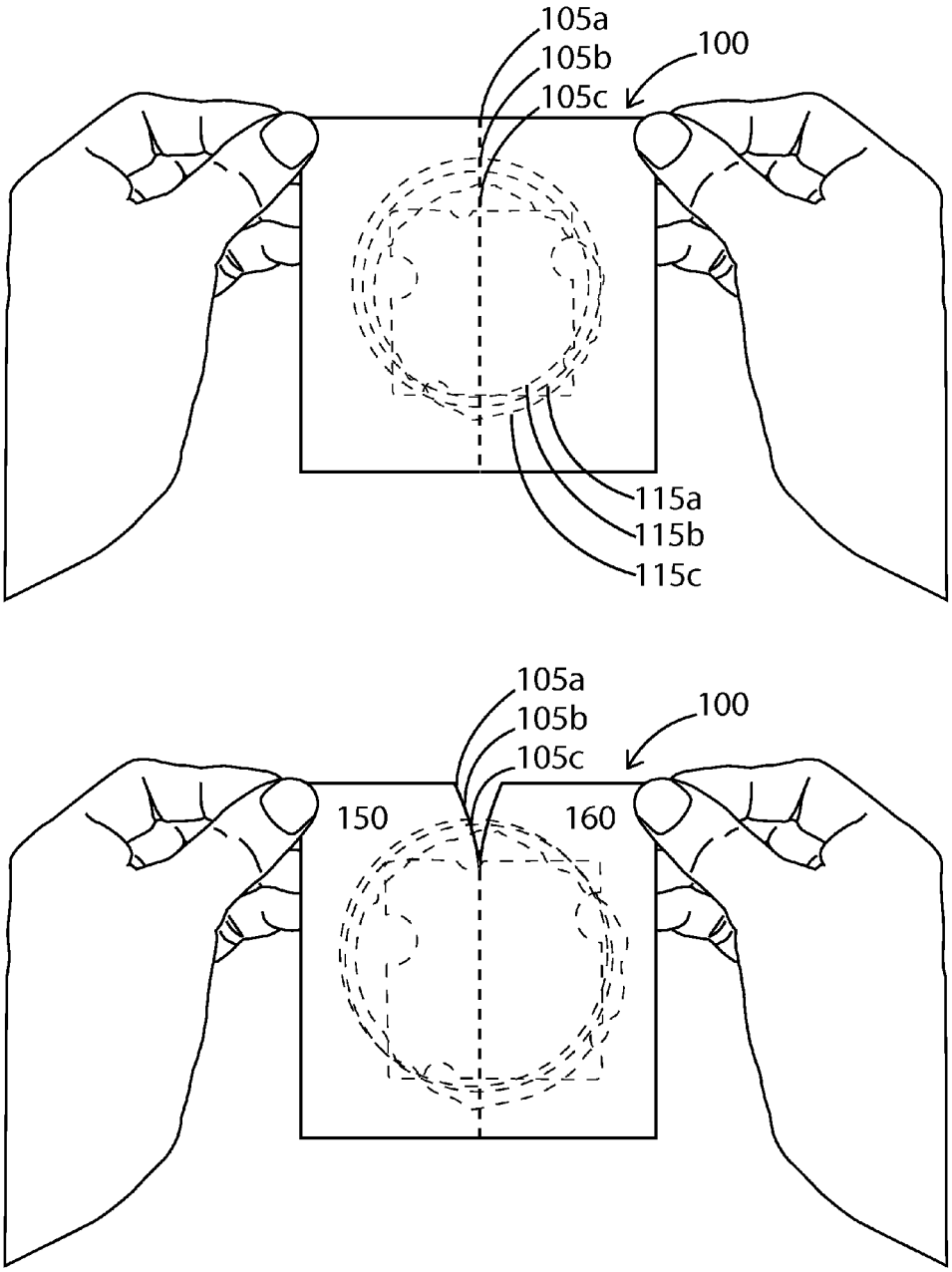
FIG. 6 illustrates one example embodiment of removal of a food isolator packaging material from a food product.

Accordingly, the arrangement depicted in FIG. 6 may be achieved. As shown in FIG. 6, the perforations 105*a*, 105*b* and 105*c* are thus aligned. Similarly, the bread layer 115*a* is thus disposed over the meat and cheese layer 115*c*, which is itself disposed over the second bread layer 115*b*. However, discrete areas C and D (not shown) are interposed between the bread layer 115*a* and the meat and cheese layer 115*c*, preventing contamination of the bread layer 115*a* by moisture or oil from the meat and cheese layer 115*c*. Similarly, discrete areas E and F (not shown) are disposed between the meat and cheese layer 115*c* and the bread layer 115*b*, preventing contamination of the bread layer 115*b* by moisture or oil from the meat and cheese layer 115*c*. Accordingly, the freshness of the sandwich food product is better preserved before consumption when the food isolator packaging is in this assembled configuration.

FIG. 6 also illustrates one example embodiment of removal of a food isolator packaging material from a food product. Accordingly, a consumer who wishes to consume the food product contained within the assembled configuration may tug or pull at distal ends 150 and 160 of the food isolator packaging 100. Accordingly, the perforations 105*a*, 105*b* and 105*c* may begin to separate simultaneously, according to the alignment of the perforations 105*a*, 105*b* and 105*c* achieved during assembly of the food isolator packaging 100 and the placement of the perforations 105*a*, 105*b* and 105*c* in each of the discrete areas A, B, C, D, E and F.

Figure 7:
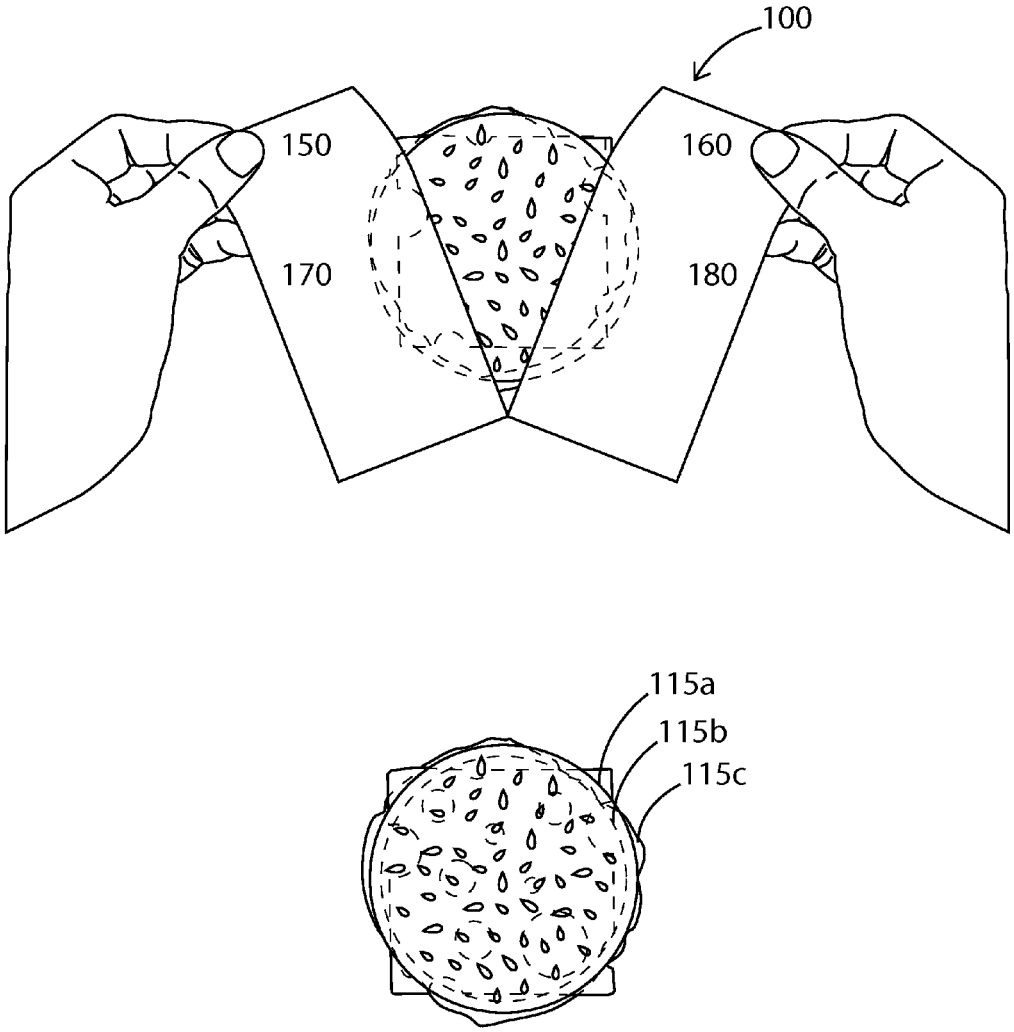
FIG. 7 illustrates one example embodiment of removal of a food isolator packaging material from a food product.

Referring now to FIG. 7, as the consumer continues to pull or tug at the distal ends 150 and 160, the food isolator packaging 100 may separate into two halves 170 and 180 according to the separation of the perforations 105*a*, 105*b* and 105*c*. When the halves 170 and 180 have been fully removed from the sandwich food product, the sandwich food product is left in the configuration achieved during assembly, with bread layer 115*a* disposed over meat and cheese layer 115*c*, which is itself disposed over the bread layer 115*b*, and is thus ready for consumption.

Figure 8:
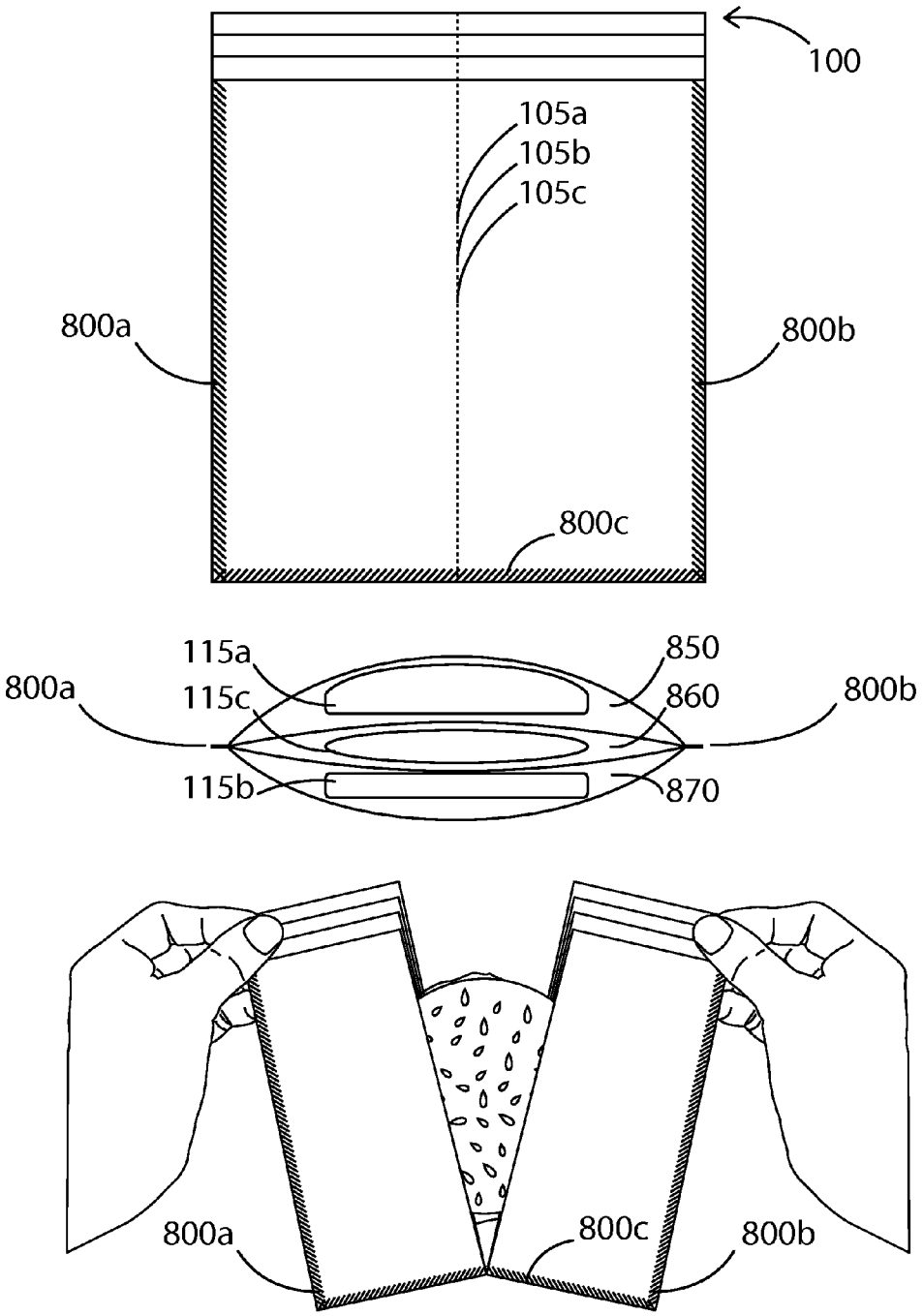
FIG. 8 illustrates one example embodiment of a food isolator packaging material with joined edges and the removal of the food isolating packaging material.

FIG. 8 illustrates one example embodiment of a food isolator packaging material with joined edges and the removal of the food isolating packaging material. Food isolator packaging 100 may in some embodiments have the edges 800*a*, 800*b* or 800*c* crimped, joined or otherwise secured (as depicted) to provide more secure packaging for the food product. Other than the crimping, joining or securing of the edges 800*a*, 800*b* and 800*c*, the food isolator packaging 100 operates in a substantially similar manner, isolating the bread layers 115*a* and 115*b* from the meat and cheese layer 115*c*. Removal of the food isolator packaging 100 may proceed as described above with reference to FIGS. 6-7.

In one alterative embodiment, the food isolator packaging 100 may be assembled in a crimped, joined or otherwise secured configuration without the folding operations described with respect to FIGS. 1-7. Accordingly, only a single layer may be disposed between each respective food layer, such as the bread layer 115*a*, the meat and cheese layer 115*c*, and the bread layer 115*b*. This may thus create pockets 850, 860 and 870, as depicted. Additional layers and pockets may be added or removed as desired or required. As before, perforations 105*a*, 105*b* and 105*c* may be provided on each layer such that the perforations 105*a*, 105*b* and 105*c* substantially align when the food isolator packaging 100 is in the assembled configuration, enabling the removal of the food isolator packaging 100 as described above with reference to FIGS. 6-7.

Different configurations of the food isolator packaging 100 are possible depending on requirement. Some of these alternatives will be described below.

Figure 9:
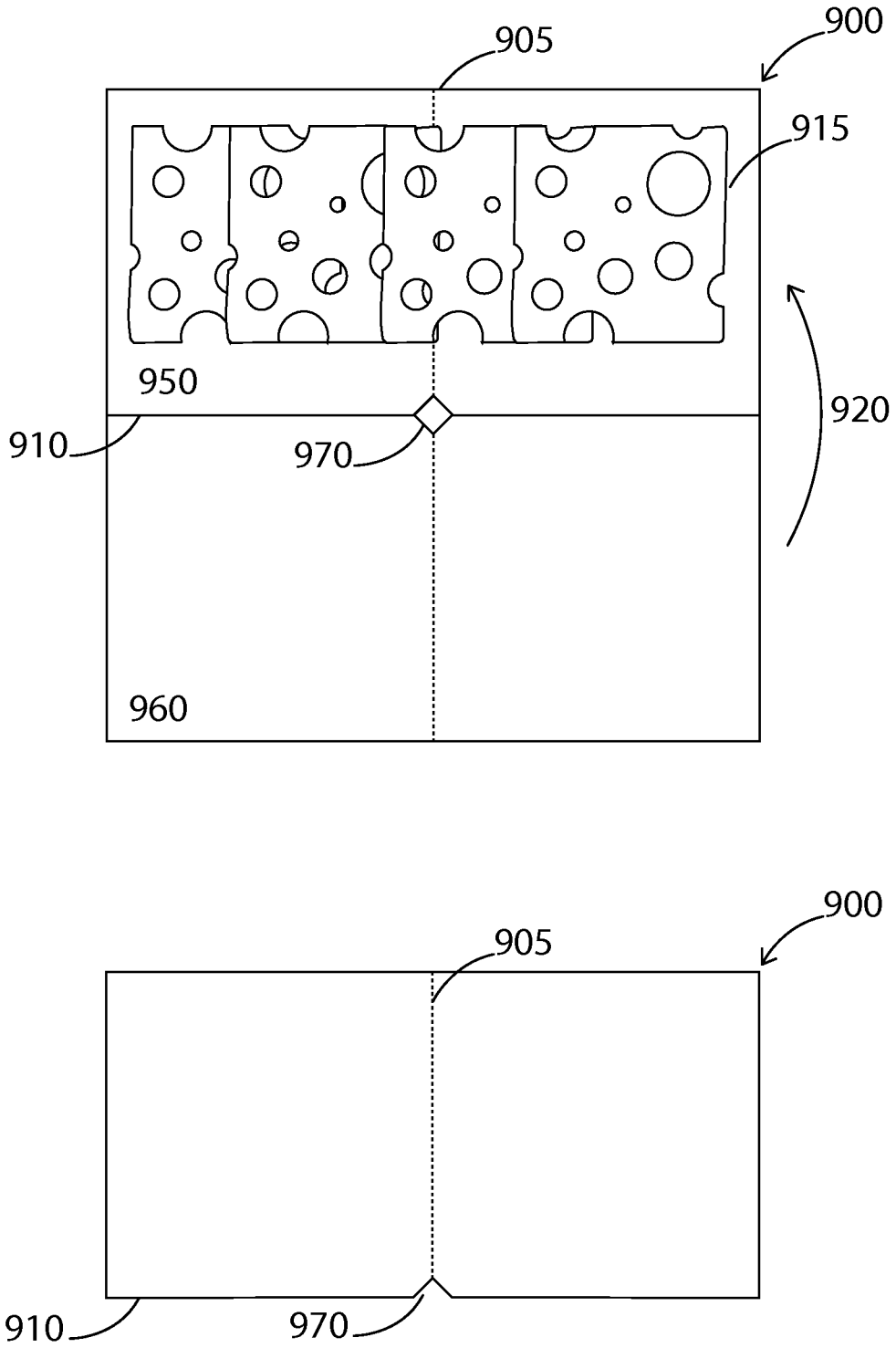
FIG. 9 illustrates one example embodiment of a food isolator packaging material configured for a particular a food product.

FIG. 9 illustrates one example embodiment of a food isolator packaging material configured for a particular food product. The embodiment shown in FIG. 9 may be utilized for a "sub sandwich" or a "hoagie," in which a long piece of bread is split and opened along a central axis, and various ingredients such as meats, cheeses, vegetables and sauces are disposed within the opening. Thus, it may be desirable to separate at least the meats, cheeses, vegetables and sauces from the bread to prevent the bread from being contaminated by moisture, oil or sauce. Additionally, layers may be interposed to prevent cross contamination of the meats, cheeses, vegetables and sauces.

Thus, a food isolator packaging 900 may possess a first section 950 and a second section 960. A perforation 905 may be made along a central axis of the food isolator packaging 900, bifurcating both the first section 950 and the second section 960. Food ingredients 915 (such as cheeses) may be placed over the first section 950. The food isolator packaging 900 may then be folded along an axis between the first section 950 and the second section 960 such that the second section 960 covers the food ingredients 915, such that the perforation 905 aligns with itself, as depicted. The food isolator packaging 900 may then be placed within the opening of the bread of the sub or hoagie sandwich. The disposition of the first section 950 between the bread and the food ingredients 915 may prevent contamination of the bread by moisture or oil from the food ingredients 915. Furthermore, after placement of the food isolator packaging 900 within the opening of the bread, further ingredients may be placed on the food isolator packaging 900, which will prevent cross contamination between the newly placed ingredients and the food ingredients 915. Tugging or pulling the food isolator packaging 900 (as described above with reference to FIGS. 6-7) may cause the perforation 905 to separate, enabling simple removal of the food isolator packaging 900. The food ingredient layers may thus be disposed according to assembly via the food isolator packaging 900 and will then be ready for consumption.

The food isolator packaging may optionally have a separation 970. The separation 970 may be punched, stamped or cut into the food separator packaging 900 during manufacturing. The separation 970 may be cut obliquely relative to the perforation 905. The cuts may be made obliquely in two angles relative to the perforation 905. When in an assembled configuration, the separation 970 may enable easier tearing of food isolator packaging 970 along the perforation 905.

Figure 10:
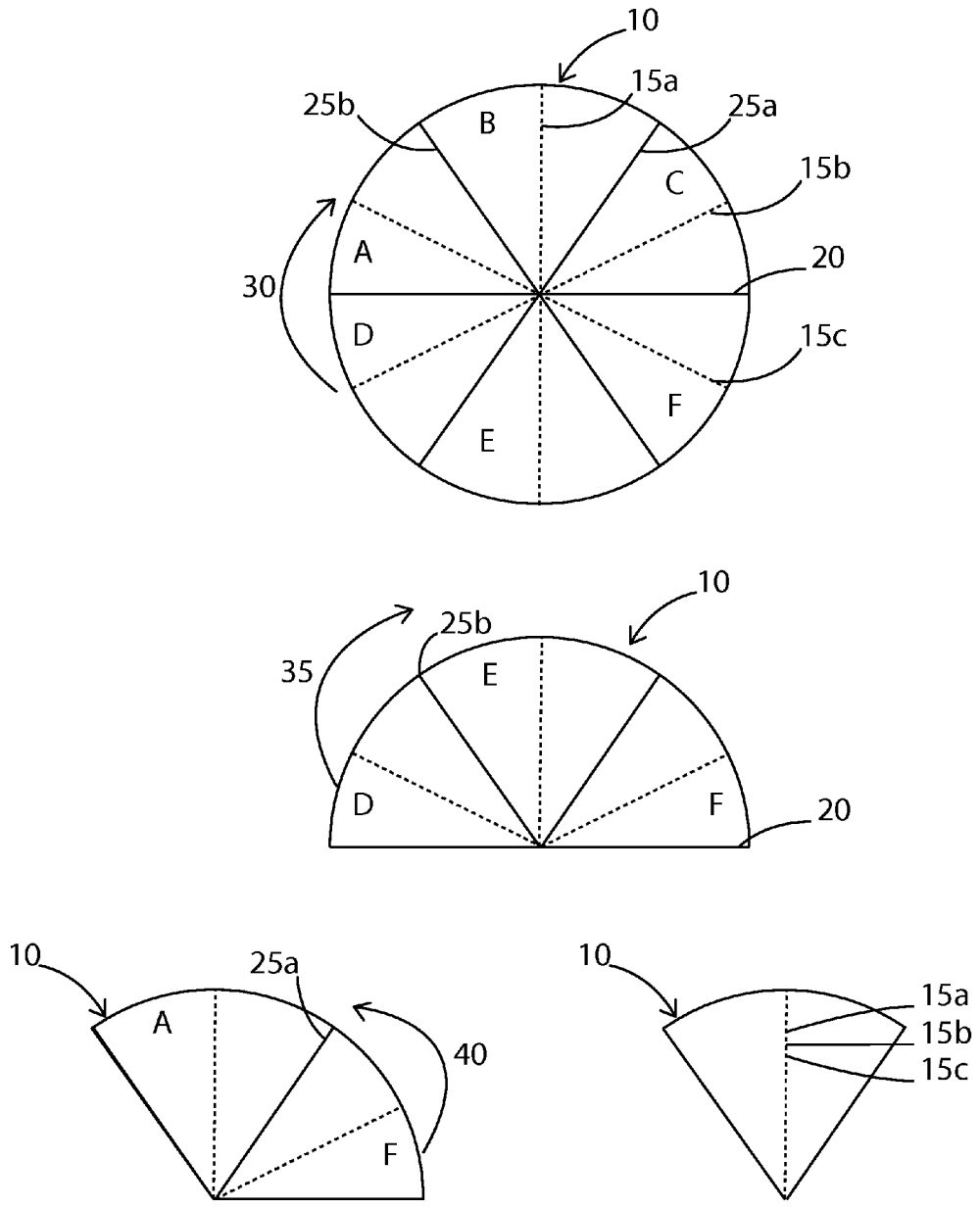
FIG. 10 illustrates one example embodiment of a food isolator packaging material configured to support a sector-shaped food product.

FIG. 10 illustrates another example embodiment of a food isolator packaging material configured to support a sector-shaped food product. Food isolator packaging 10 may, in this embodiment, have a substantially circular shape. As with the example described above with reference to FIGS. 1-7, the food isolator packaging 10 may include a number of discrete areas A, B, C, D, E and F. A number of perforations 15*a*, 15*b* and 15*c* are provided, bifurcating each of the discrete areas A, B, C, D, E and F. Additionally, as with the example described above with reference to FIGS. 1-7, the food isolator packaging 10 may be divided into two sections, here a top semicircle including the discrete areas A, B and C, and a bottom semicircle including the discrete areas D, E and F. The top semicircle and bottom semicircle may be defined according to an axis 20. This axis 20, along with creases or folds 25*a* and 25*b* may thus define the discrete areas A, B, C, D, E and F.

As in the previous embodiment of FIGS. 1-7, after the deposition of food ingredients in the discrete areas A, B and C, the food isolator packaging 10 may be assembled. First, the bottom semicircle may be folded according to operation 30 to cover the deposited food ingredients. Subsequently, the food isolator packaging 10 may be folded along crease 25*b* according to operation 35. The food isolator packaging 10 may again be folded along crease 25*a* in operation 40, resulting in the assembled configuration. As described above with reference to FIGS. 1-7, food ingredients are separated by the respective layers of the food isolator packaging 100, with discrete areas D & E disposed between two layers of ingredients, and discrete areas A & F disposed between two layers of ingredients, thereby preventing cross contamination of the food ingredients. As described above with reference to FIGS. 1-7, the perforations 15*a*, 15*b* and 15*c* are aligned in the assembled configuration, according to the placement of the creases 25*a*, 25*b* and axis 20, and the perforations 15*a*, 15*b* and 15*c*. Removal may thus be effectuated as described above with reference to FIGS. 6-7.

Figure 11:
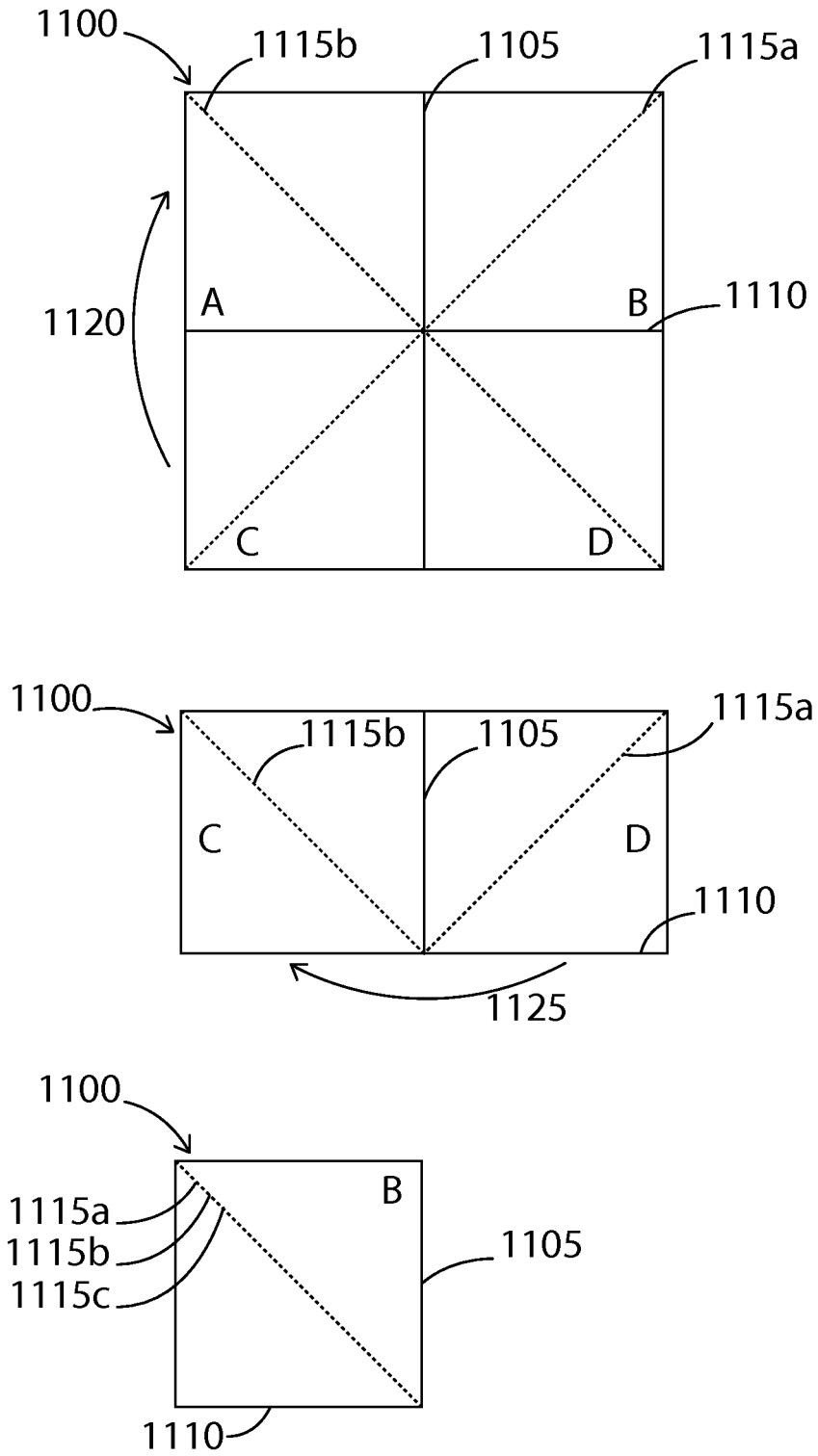
FIG. 11 illustrates one example embodiment of a food isolator packaging material configured with an oblique set of perforations.

FIG. 11 illustrates one example embodiment of a food isolator packaging material configured with an oblique set of perforations. The perforations do not need to be parallel or perpendicular with the respective axes of folding and creasing (as they are in the embodiment shown in FIGS. 1-7). According, a set of oblique perforations 1115*a* and 1115*b* are provided for the food isolator packaging 1100.

The food isolator packaging 1100 may again be provided with discrete areas A, B, C and D, with a first section including discrete areas A and B, and a second section including discrete areas C and D. Food ingredients (not depicted) may be deposited on the first section within the discrete areas A and B. Subsequently, the second section may be folded along axis 1110 to cover the deposited food ingredients according to operation 1120. The food isolator packaging 1100 may again be folded along crease 1105 via operation 1125, resulting in the assembled configuration. Again, the respective food ingredient layers are isolated from one another via the interposition of discrete areas C and D. Again, the perforations 1115*a*, 1115*b* and 1115*c* are aligned in the assembled configuration because of the placement of the perforations 1115*a* and 1115*b* and the placement of the creases 1105 and axis 1110.

Removal of the food isolator packaging 1100 may again be conducted as described above with references to FIGS. 6 and 7, except the portions of the food isolator packaging 1100 ideal for tugging or pulling will be disposed along an oblique axis of the food isolator packaging 1100 because of the oblique formation of the perforations 1115*a*, 1115*b* and 1115*c*.

Figure 12:
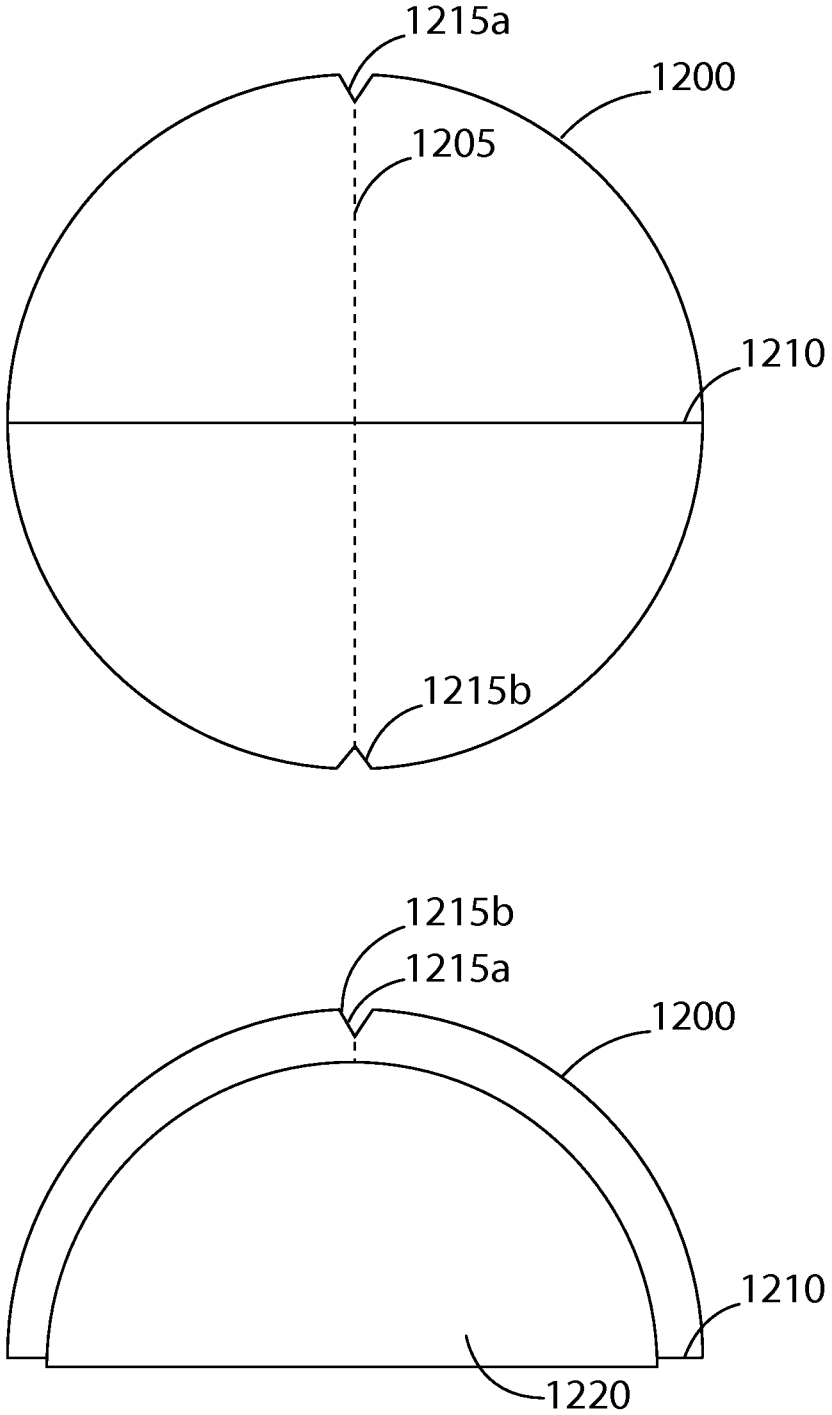
FIG. 12 illustrates one example embodiment of a food isolator packaging material configured to support another type of food product.

FIG. 12 illustrates one example embodiment of a food isolator packaging 1200 material configured to support another type of food product, such as a taco shell 1220. As with the previous embodiments, food isolator packaging 1200 may have a perforation 1205, a separation 1215*a* and 1215*b*, and an axis 1210. The food isolator packaging 1200 may be placed within a taco shell 1220 to protect the taco shell 1220 from moisture or oil from food within the taco shell 1220.

Figure 13:
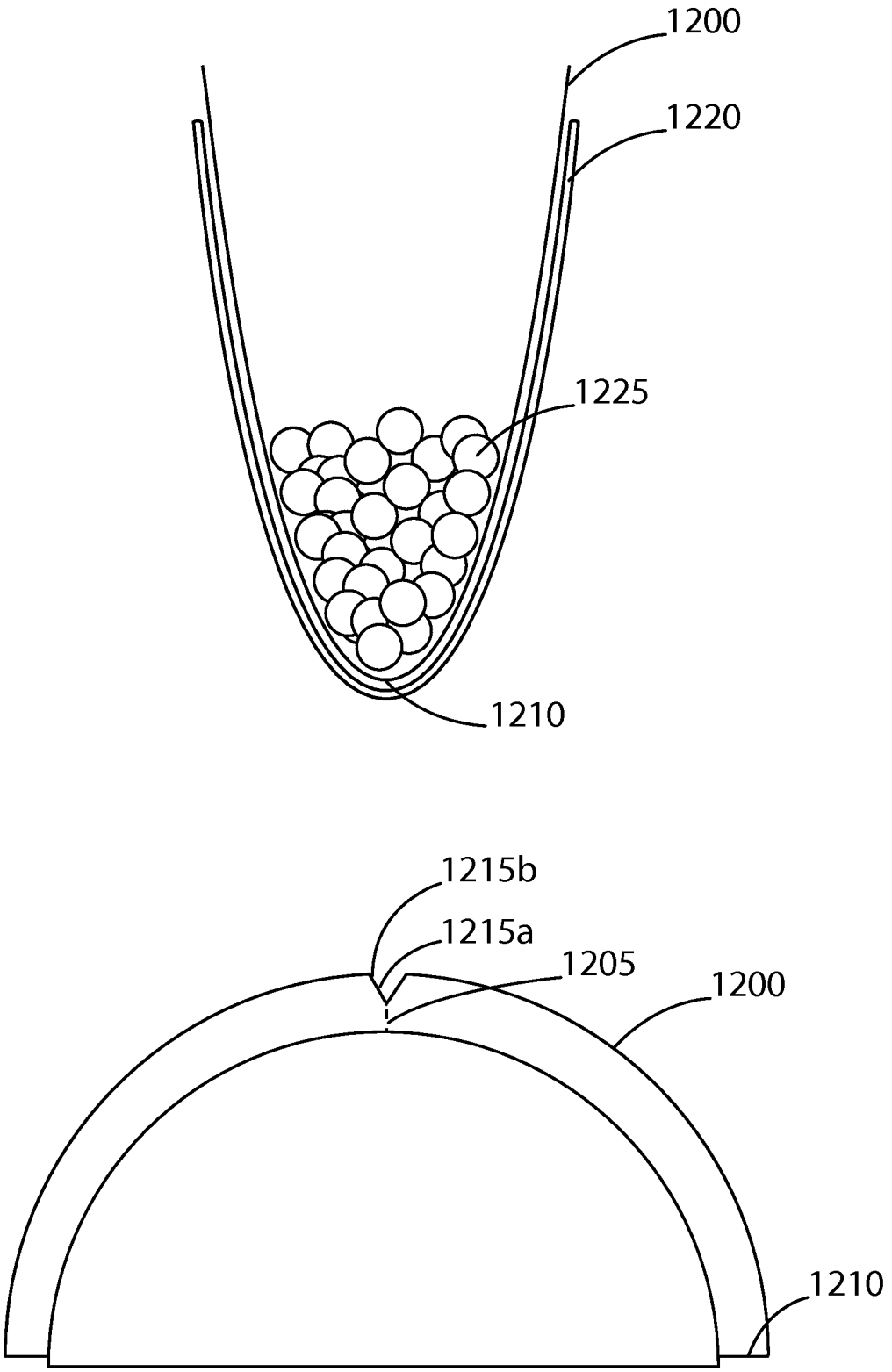
FIG. 13 illustrates one example embodiment of a food isolator packaging material configured to support another type of food product.

For example, referring now to FIG. 13, meat, cheese, and/or sauces 1225 may be placed within the taco shell 1220. Thus, the taco shell 1220 is protected from moisture or oil from the meat, cheese and/or sauces 1225 by the interposition of the food isolator packaging 1200. As before, the perforation 1205 may substantially align, in addition to the separations 1215*a* and 1215*b*.

Figure 14:
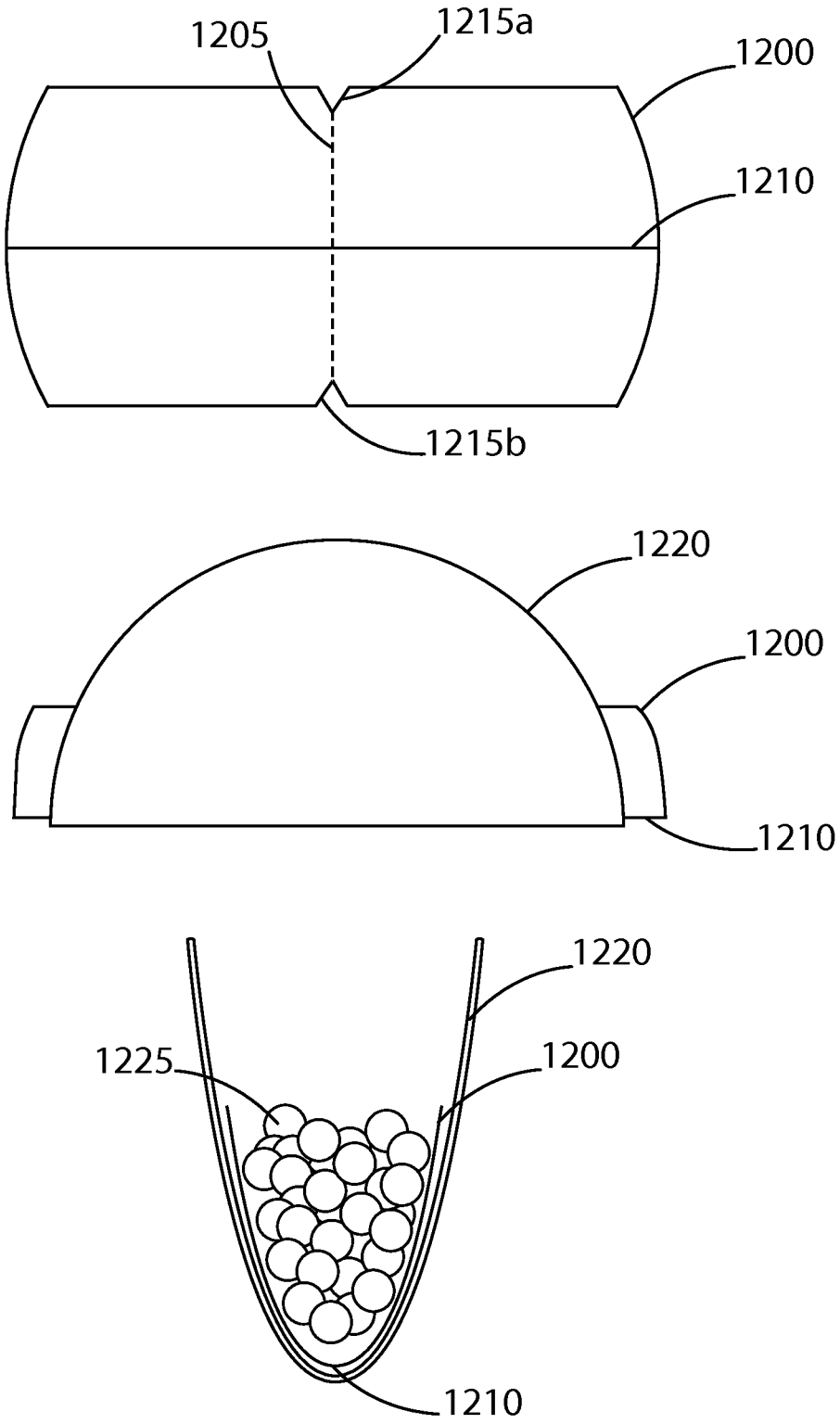
FIG. 14 illustrates one example embodiment of a food isolator packaging material configured to support another type of food product.

Referring to FIG. 14, another variation of the above may be seen, except in that the food isolator packaging 1200 may be reduced in area so as to more closely support the insertion of meat, cheese and/or sauces 1225. In this way, manufacturing cost may be reduced by the use of a reduced amount of material, while retaining the full benefit of the food isolator packaging 1200.

Figure 15:
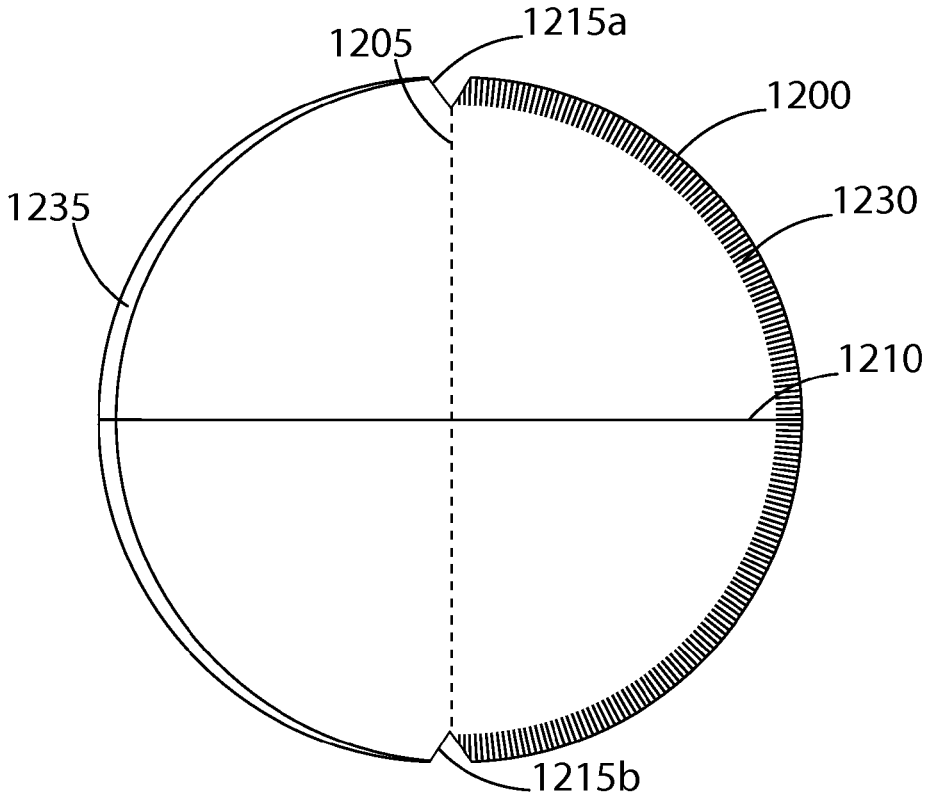
FIG. 15 illustrates one example embodiment of a food isolator packaging material configured to support another type of food product.
Figure 15:
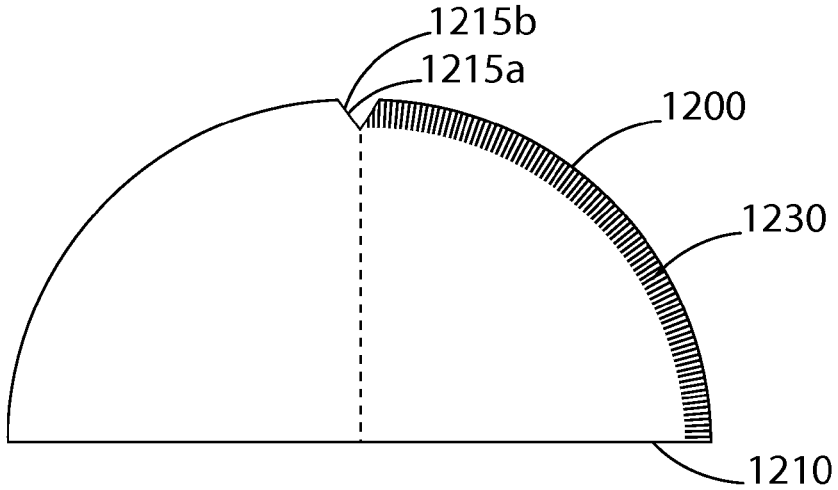
Figure 16:
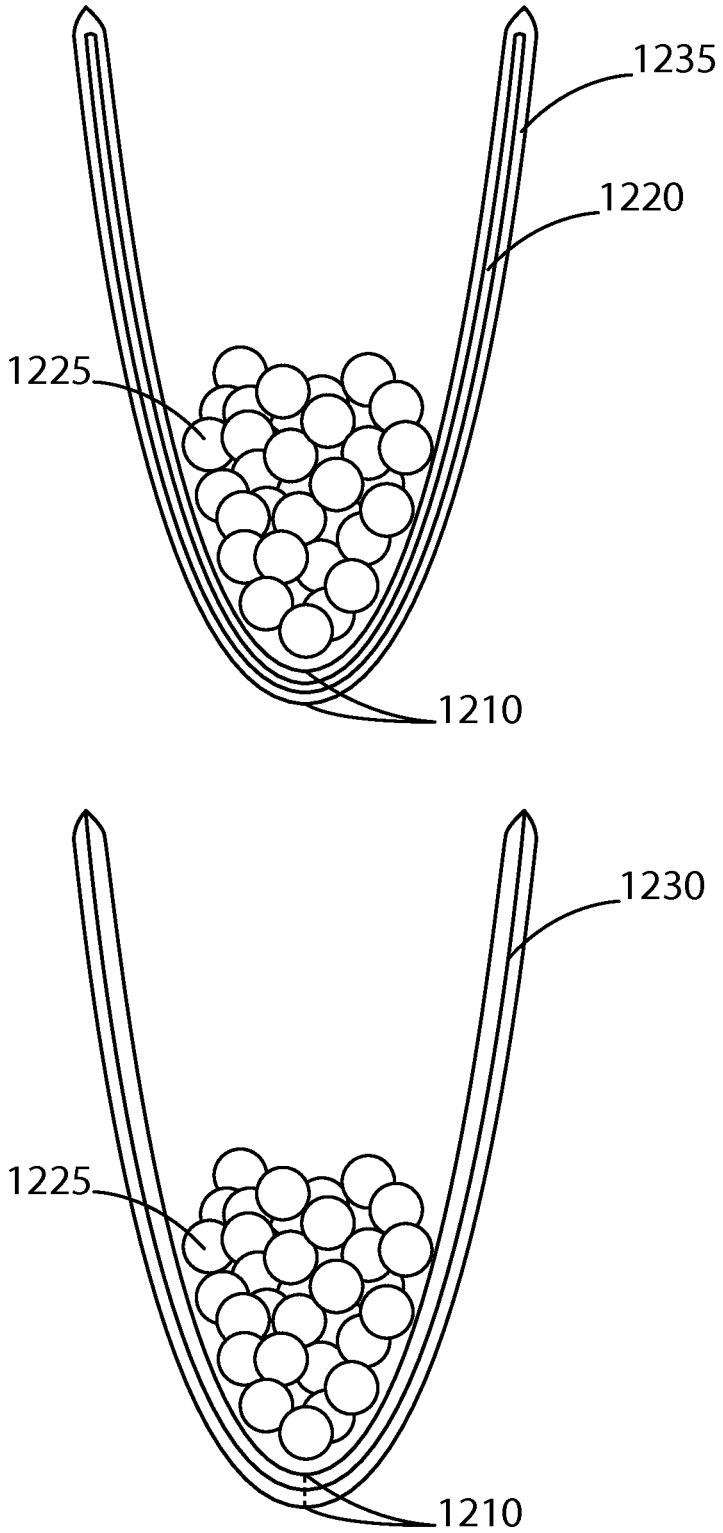
FIG. 16 illustrates one example embodiment of a food isolator packaging material configured to support another type of food product.

Referring to FIG. 15, another variation of the present embodiment may be seen in that two food isolator packaging 1200 may be joined on one end 1230 and thus provide a pocket opening 1235, allowing for insertion of a taco shell (not shown). As before, in the assembled state, the perforations 1205 and separations 1215*a* and 1215*b* substantially align when the food isolator packaging 1200 is in an assembled configuration. Referring to FIG. 16, from the perspective of one end, the taco shell 1220 may thus be exposed on the side having the opening 1235. The taco shell 1220 is thus not exposed on the joined end 1230.

Figure 17:
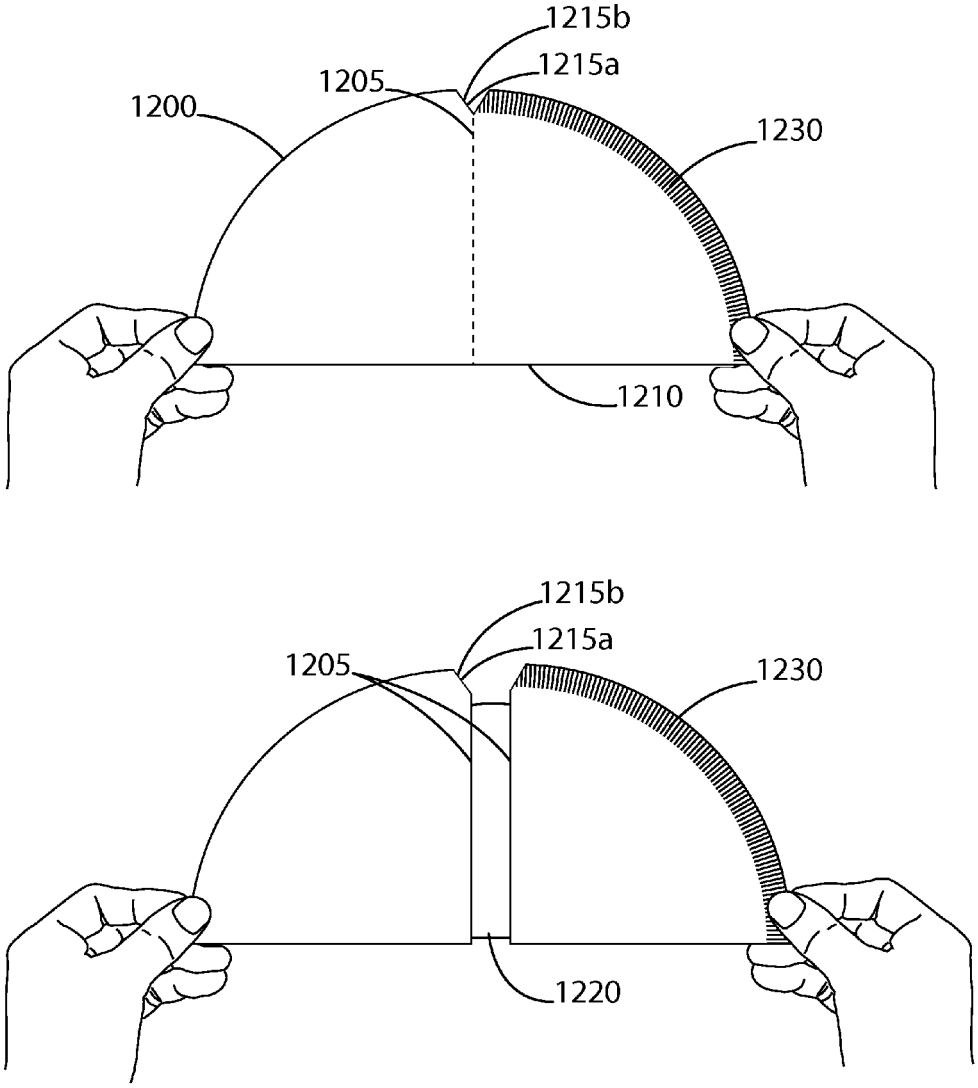
FIG. 17 illustrates one example embodiment of a food isolator packaging material configured to support another type of food product.

Referring to FIG. 17, as described in previous embodiments, the food isolator packaging 1200 may be separated into two halves when consumption of the food product is desired. Tension may be applied to opposing ends of the food isolator packaging 1200 as depicted, causing the food isolator packaging 1200 to break at the perforation 1205, aided in some embodiments by the aligned separations 1215*a* and 1215*b*.

As will be appreciated by one of ordinary skill in the art, any number of discrete areas, creases, folds and perforations may be provided, and the disclosure should not be construed to be limited to the embodiments described in detail above. Similarly, the shape of the food isolator packaging material, and the shape of the discrete areas may vary according to the need of the manufacturer, the shape of the food product being assembled, the desired form of packaging, or any other relevant consideration. The perforations may be configured to extend from edge to edge, from edge to an interior point of the food isolator packaging, or from an interior point of the food isolator packaging to an edge. The perforations may take on a variety of dimensions, and are not restricted to a straight line. The perforations may be made to be jagged, curved, etc. One or more edges of the food isolator packaging in the assembled configuration may be crimped, joined, stapled, fastened or generally supported in any way to provide additional stability to the assembled food product.

While this invention has been particularly shown and described with reference to several exemplary embodiments thereof, it will be understood by those skilled in the art that various changes in form and detail may be made therein without departing from the spirit and scope of the invention as defined by the appended claims.

What is claimed is:

1. A method of assembling a food product, comprising:

providing a food isolator packaging including a first section and a second section, the first section including a plurality of deposit areas each having a line of perforations;

depositing a first food layer on a first deposit area of the plurality of deposit areas and positioned over said line of perforations of said first deposit area, and depositing a second food layer on a second deposit area of the plurality of deposit areas and positioned over said line of perforations of said second deposit area;

folding the food isolator packaging such that the second section covers the first food layer in the first deposit area and the second food layer in the second deposit area; and folding the food isolator packaging along an axis situated between the first deposit area and the second deposit area such that said line of perforations of the first deposit area and said line of perforations of the second deposit area are in alignment.

2. The method of claim 1, further comprising:

depositing a third food layer on a third deposit area of the plurality of deposit areas and positioned over said line of perforations of said third deposit area;

folding the food isolator packaging such that the second section covers the third food layer in the third deposit area; and folding the food isolating packaging along an axis situated between the first deposit area and the third deposit area such that the line of perforations of the first deposit area and said line of perforations of the third deposit area are in alignment.

3. The method of claim 1, wherein when all of said lines of perforations of the plurality of deposit areas are in alignment, the food isolator packaging is in an assembled configuration.

4. The method of claim 3, wherein all of said lines of perforations of the plurality of deposit areas are configured to be broken simultaneously according to the alignment when the food isolator packaging is in the assembled configuration.

5. The method of claim 4, wherein the food isolator packaging is configured to separate into a first half and a second half when all of said lines of perforations of the plurality of deposit areas are broken simultaneously according to the alignment, and the first half and second half are configured to be removed in opposing directions.

6. The method of claim 1, wherein the first section and the second section are shaped as at least one of a rectangle, a square, and a sector.

7. The method of claim 1, wherein all of said lines of perforations are situated along a center axis of each respective deposit area of the plurality of deposit areas.

8. The method of claim 7, wherein all of said lines of perforations extend from the first section to respective terminal ends of the second section.

* * * * *